US009886856B2

(12) United States Patent
Dougherty

(10) Patent No.: US 9,886,856 B2
(45) Date of Patent: Feb. 6, 2018

(54) NEAR MISS SYSTEM

(71) Applicant: HERE Global B.V., Veldhoven (NL)

(72) Inventor: Chris Dougherty, Highland Park, IL (US)

(73) Assignee: HERE Global B.V., Eindhoven (NL)

( * ) Notice: Subject to any disclaimer, the term of this patent is extended or adjusted under 35 U.S.C. 154(b) by 27 days.

(21) Appl. No.: 14/560,892

(22) Filed: Dec. 4, 2014

(65) Prior Publication Data

US 2016/0163198 A1 Jun. 9, 2016

(51) Int. Cl.
*G08G 1/09* (2006.01)
*G08G 1/16* (2006.01)

(52) U.S. Cl.
CPC ..... *G08G 1/162* (2013.01)

(58) Field of Classification Search
CPC ..... G08G 1/16; G08G 1/161; G08G 1/162; G08G 1/163; G08G 1/165; G08G 1/166
See application file for complete search history.

(56) References Cited

U.S. PATENT DOCUMENTS 8,134,478 B2 3/2012 Denaro
8,229,663 B2 * 7/2012 Zeng ..... B60W 40/02 180/168
8,630,768 B2 1/2014 McClellan et al.
8,952,830 B2 * 2/2015 Sims ..... B60Q 9/008 340/425.5
8,995,662 B2 * 3/2015 Rubin ..... G08G 9/02 370/345
9,734,415 B2 * 8/2017 Mitoma ..... G06K 9/00805
2009/0157255 A1 6/2009 Plante
2009/0299622 A1 12/2009 Denaro
2013/0253809 A1 9/2013 Jones et al.
2013/0338914 A1 12/2013 Weiss
2014/0104077 A1 * 4/2014 Engel ..... G08G 1/0962 340/901
2014/0145838 A1 * 5/2014 Tuukkanen ..... B60Q 1/085 340/436
2016/0042644 A1 * 2/2016 Velusamy ..... G08G 1/162 340/435

FOREIGN PATENT DOCUMENTS

WO WO2012071054 A2 5/2012

OTHER PUBLICATIONS

Boyce et al., A Technology to Measure Multiple Driving Behaviors Without Self-Report or Participant Reactivity, Spring 2001, Journal of Applied Behavior Analysis.
Hirai et al., Incident Detection Using Probe Data Determining Thresholds of a Near Miss, Accessed Oct. 10, 2014, National Institute for Land and Infrastructure Management.

* cited by examiner

*Primary Examiner* — Ryan Sherwin
(74) *Attorney, Agent, or Firm* — Lempia Summerfield Katz LLC

(57) ABSTRACT

Systems, methods, and apparatuses are described for communicating the occurrence of incident near misses between vehicles. In one embodiment, for example, a controller receives sensor data related to an operation of a vehicle. The sensor data is analyzed to determine whether a near collision has occurred with respect to the vehicle. A warning message is generated and transmitted in response to the determination that a near collision occurred.

19 Claims, 10 Drawing Sheets

NEAR MISS SYSTEM

FIELD

The following disclosure relates to a near miss system, or more particularly, to the identification of near misses of a vehicle accident and communication of the near misses to nearby or related vehicles.

BACKGROUND

A collision avoidance system or a forward collision warning may warn a driver of an imminent collision. For example, the vehicle may be equipped with lasers or radar to detect objects in the vicinity of the vehicle. The nearby objects may be other vehicles, buildings, signs, pedestrians or pets. The distances between the nearby objects and the vehicle are measured. When there's a risk of hitting the nearby object, the system may sound an alarm to alert the driver. In an autonomous vehicle, the vehicle may also automatically apply the brakes or tighten the seat belts.

The data from collision avoidance systems are used in closed systems. That is, the detection of nearby objects are made at the vehicle and the alerts are provided to the passengers of the same vehicle. The closed systems do not provide any opportunity for compiling the occurrences of nearby objects across multiple vehicles or multiple instances in time.

SUMMARY

In one embodiment, a method, or apparatus for performing the method, includes receiving sensor data related to an operation of a vehicle, receiving location data indicative of a location of the vehicle, and analyzing the sensor data to determine whether a near collision has occurred with respect to the vehicle. A warning message is generated in response to the determination of a near collision. A mobile device based on the location data for the vehicle is selected, and the warning message is sent to the mobile device.

In another embodiment, a method, or apparatus for performing the method, includes, receiving sensor data related to an operation of a vehicle and analyzing the sensor data to determine whether a risky maneuver or near miss has occurred with respect to the vehicle. A warning message is generated in response to the determination that a risky maneuver or a near miss has occurred. The warning message is transmitted to a device external to the vehicle.

BRIEF DESCRIPTION OF THE DRAWINGS

Exemplary embodiments are described herein with reference to the following drawings.

DETAILED DESCRIPTION

A near miss or a near collision is an event that has the potential to cause an injury or damage. The near collision may be unplanned event that was close to a vehicle accident, but the accident was avoided. The near miss may be a risky maneuver characterized by sudden deceleration or swerving. The near miss may occur when two vehicles, or a vehicle and an object, come within a certain distance from each other. The near miss may occur when one or more vehicles are traveling at a particular speed and trajectory that would result in a collision if continued. The near miss may occur when the vehicle experiences an unexpected motion such as sudden braking or swerving. The near miss may occur when the driver experiences a particular reaction such as increased heart rate or a tight grip on the steering wheel.

Data indicative of the near miss may be presented to the driver. For example, an alarm or display may inform the driver of the current dangerous situation or imminent danger. In addition or in the alternative, the near miss may be communicated to another location. The near miss may be communicated to a central location for logging or analysis. The near miss may be communicated to other vehicles in the vicinity of the vehicle that experienced the near miss. The near miss may be communicated to a driver assistance system of a nearby vehicle to adjust the speed or direction of the vehicle.

Figure 1:
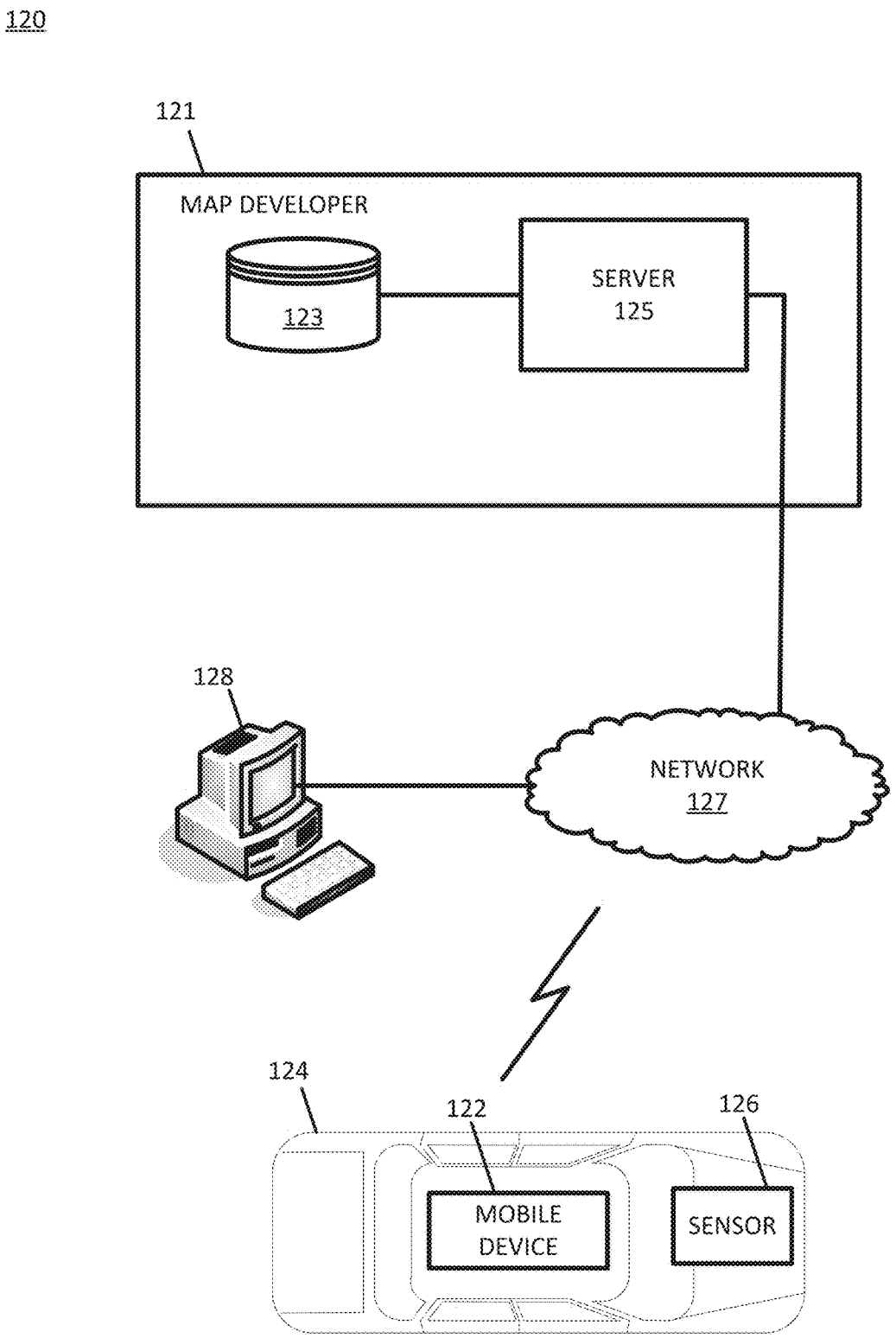
FIG. 1 illustrates an example system for communicating near miss warnings.

FIG. 1 illustrates an example system 120 for communicating near miss warnings. The system 120 includes a developer system 121, one or more mobile devices 122, a workstation 128, and a network 127. Additional, different, or fewer components may be provided. For example, many mobile devices 122 and/or workstations 128 connect with the network 127. The developer system 121 includes a server 125 and one or more databases. The database 123 may be a geographic database including road links or segments.

The mobile device 122 may receive sensor data related to the operation of vehicle 124. In one example, the sensor data includes location data (e.g., geographic coordinates) from a global positioning system (GPS). The location data may be analyzed to determine the speed, acceleration, or change in acceleration of the vehicle 124. The sensor data may also include measurement from the sensor 128. The sensor 128 may include a proximity sensor, a light detection and ranging (LIDAR) sensor, radar, electromagnetic field sensor, infrared sensor, camera, or another sensor.

In one example, the mobile device 122 analyzes the sensor data to determine when a near collision has occurred with respect to the vehicle 125. In another example, the mobile device 122 sends the sensor data to the server 125, which analyzes the sensor data. The analysis may determine if the vehicle 124 becomes dangerously close to another vehicle. The analysis may determine if the vehicle 124 is traveling on a course that will likely result in a collision.

The mobile device 122 or the server 125 may generate a warning message in response to the near collision determined from the sensor data. The warning message may be presented to a driver of the vehicle 124. The warning message may be an audible alarm to alert the driver. The warning message may be displayed on the mobile device 122. The warning message may be sent to other mobile device 122 through the network 127 or directly. The body of the warning message (audio content, graphics, or text) may state that a near miss or a risk of a collision has occurred near the other mobile device 122. The body of the warning message may describe the event that triggered the warning message. Example descriptions of the event may include obstacle in the road, erratic driver, flooding, sudden traffic, accident, or other events. The body of the warning message may state a relationship between the receiving mobile device 122 and the sending mobile device 122. The relationship may indicate a relative location such as behind, to the left, to the right, or behind, indicate a general location such as ahead on this road, behind on this road, indicate a lane such as left lane, right lane, middle lane, or other description that informs the driver of a general direction or location of the event that triggered the warning message.

The server 125 may monitor the locations of multiple vehicles and determine when multiple vehicles are near the location of the near miss. Locations of the vehicles may be stored in the database 123. The database 123 may also store or maintain geographic data such as, for example, road segment or link data records and node data records. The link data records are links or segments representing the roads, streets, or paths. The node data records are end points (e.g., intersections) corresponding to the respective links or segments of the road segment data records. The road link data records and the node data records may represent, for example, road networks used by vehicles, cars, and/or other entities.

The mobile device 122 may be a personal navigation device ("PND"), a portable navigation device smart phone, a mobile phone, a personal digital assistant ("PDA"), a tablet computer, a notebook computer, and/or any other known or later developed mobile device or personal computer. Non-limiting embodiments of navigation devices may also include relational database service devices, mobile phone devices, or car navigation devices. The mobile device 122 may be integrated in the vehicle 124, or the mobile device 122 may include the vehicle 124. Example integrations of the mobile device 122 in the vehicle 124 include navigation systems and the automated driving systems is assisted driving vehicles described below. The mobile device 122 may be a standalone near miss warning system that may be integrated in the vehicle 124.

The developer system 121, the workstation 128, and the mobile device 122 are coupled with the network 127. The phrase "coupled with" is defined to mean directly connected to or indirectly connected through one or more intermediate components. Such intermediate components may include hardware and/or software-based components.

The computing resources may be divided between the server 125 and the mobile device 122. In some embodiments, the server 125 performs a majority of the processing for identifying the near miss condition and where to send the near miss warning messages. In other embodiments, the mobile device 122 or the workstation 128 performs a majority of the processing for identifying the near miss condition and where to send the near miss warning messages. Alternatively, the processing is divided substantially evenly between the server 125 and the mobile device 122 or workstation 128.

Figure 2:
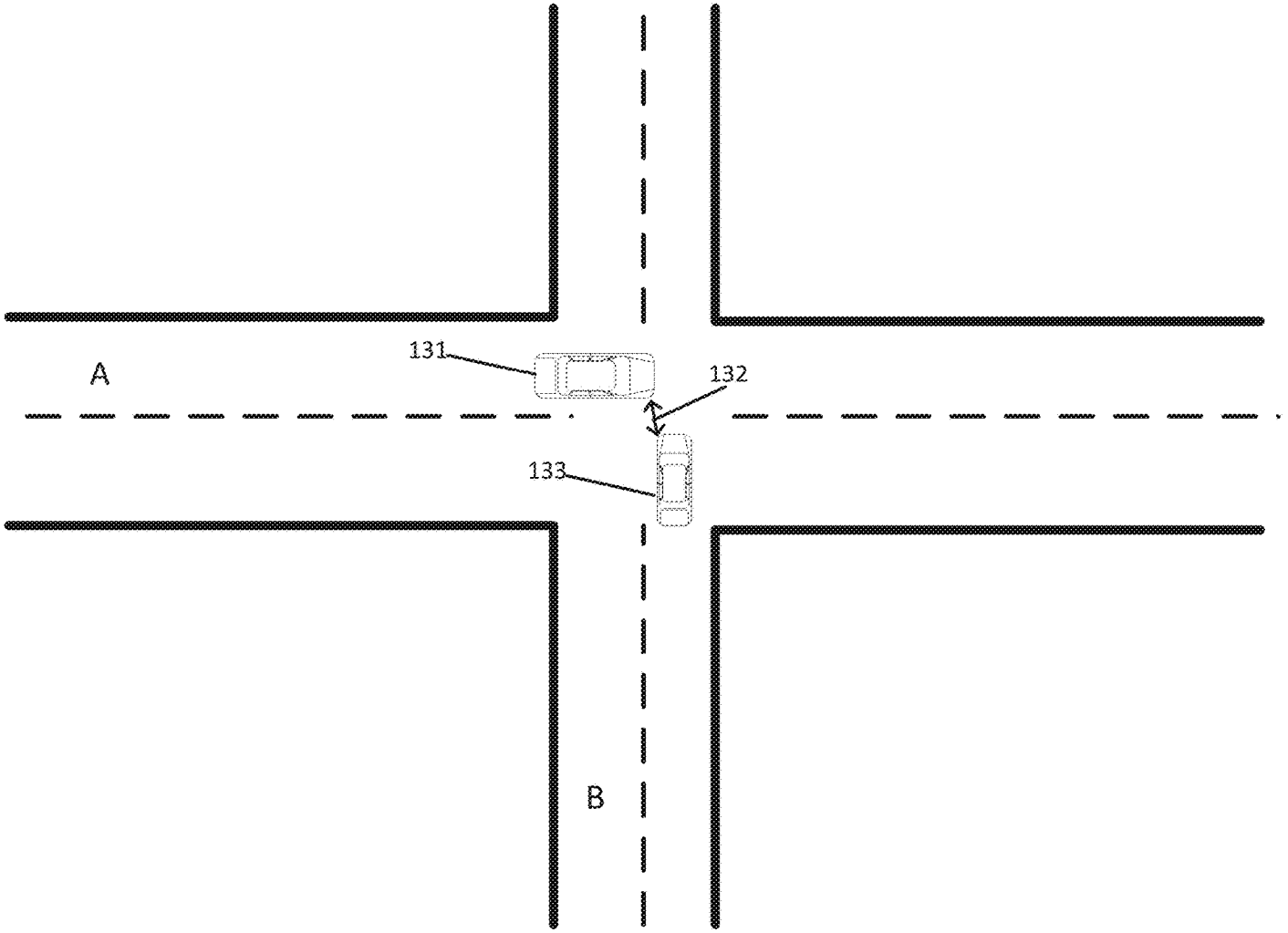
FIG. 2 illustrates an example near miss between two vehicles.

FIG. 2 illustrates an example near miss between two vehicles. A vehicle 131 is traveling on road A in one direction (e.g., left to right), and vehicle 133 is traveling on road B in another direction (e.g., bottom to top). Road A and road B intersect. Road A and road B may be represented in the database 123 by road segments or links.

The vehicle 131 and vehicle 133 are shown in a near miss situation because a distance 132 between the vehicles are within a distance threshold. The distance 132 may be determined based on the location data reported by the vehicles. The distance may be a Euclidean distance based on a difference between longitude coordinates and a difference between latitude coordinates. Alternatively, the distance may be determined by a distance sensor such as a laser, an infrared sensor, or an optical sensor.

The distance threshold may be a set value set by the user. The user may configure the near miss system by defining the distance that constitutes a near miss. Example threshold distances may include 0.5 meters, 1 meter, or 2 meters. The distance may be changed over time or may be automatically finely tuned based on results. For example, when a certain number of near misses are detected in a time period, the distance threshold may be set too large. Decreases the distance threshold in this situation may reduce the occurrence of false positives.

The distance threshold may be variable. In one example, the distance threshold is defined as a function of the speed of the vehicle or as a function of the speed limit associated with the road segment in the database 123. Higher speed limits are assigned larger threshold distances. Thus, a near miss on a city street is detected only at relatively small distances between vehicles, and a near miss on a highway is detected even at larger distances. The distance threshold may be determined according to the functional class of the road. The distance threshold may be determined according to a geographic region. Larger distance thresholds may be applied to rural areas and smaller distance threshold may be applied to urban areas.

The distance threshold may be set based on the characteristics of a sensor. For example, a proximity sensor may detect objects with a small distance (e.g., 1 meter). Thus, any objects detectable by the proximity sensor may be considered within the distance threshold and trigger a near miss.

Figure 3:
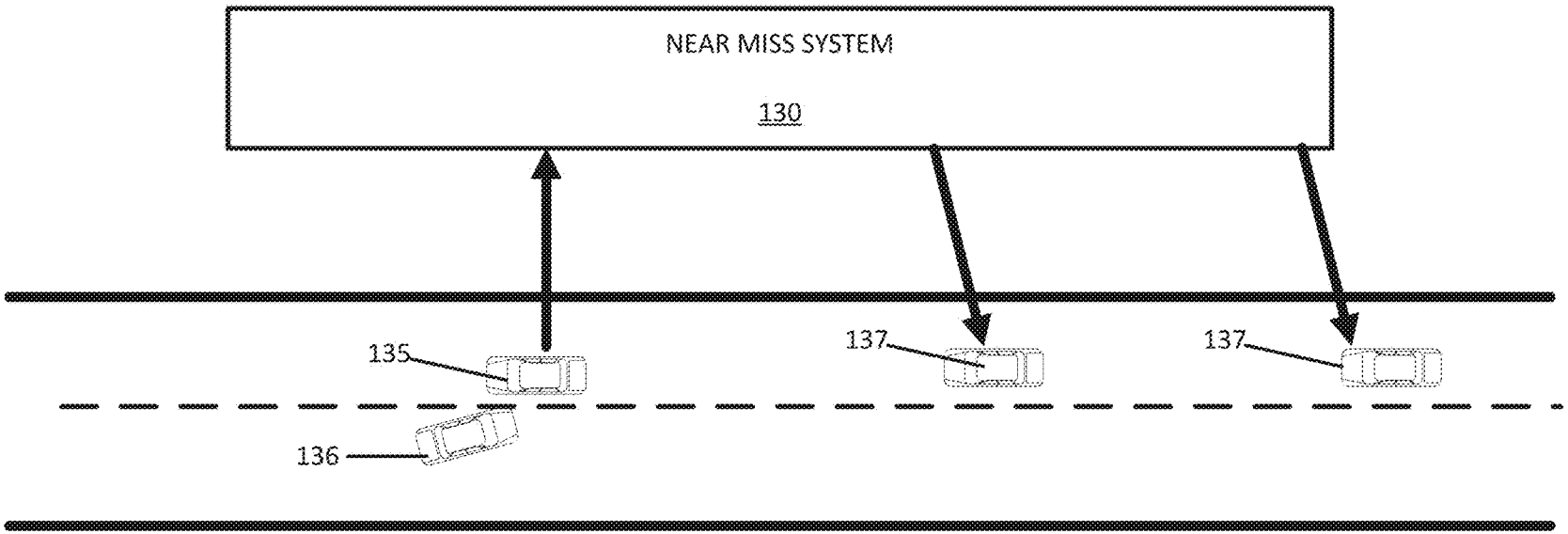
FIG. 3 illustrates example communication of near miss warnings.

FIG. 3 illustrates example communication of near miss warnings. Vehicle 135 and vehicle 136 are experiencing a near miss. The vehicle 136 may have swerved toward vehicle 135. The vehicle 136, and/or optionally also vehicle 135, may detect the near miss and generate a near miss message, which is sent to a near miss system 130. Alternatively, the near miss system 130 receives the sensor data and determines that a near miss has occurred. The near miss system 130 may be implemented by the mobile device 122 or the server 125 individually or in combination. The near miss system 130 may identify that vehicles 137 are in the geographical proximity to the near miss. The near miss system 130 may send warnings to the vehicles 137.

In one example, the near miss system 130 identifies a geographic region based on the location data from the vehicle that experienced the near miss. The geographic region may be defined according to a radius. Example radii include 10 feet, 10 meters, and 100 meters. The near miss system 130 may monitor the geographic locations of multiple mobile devices and select a subset of mobile devices that are within the radius to the vehicle that experienced the near miss.

In another example, the near miss system 130 may identify one or more vehicles having a specific relationship to the vehicle that experienced the near miss. When the near miss is caused by a stationary object (e.g., obstacle near the roadway), the near miss system 130 may identify vehicles heading toward the stationary object. The vehicles may be downstream vehicles traveling in the opposite direction as the vehicle that experienced the near miss. Downstream vehicles traveling in the opposite direction are heading toward the stationary object. The vehicles may be upstream vehicles traveling in the same direction as the vehicle that experienced the near miss. Upstream vehicles located behind the vehicle that experienced the near miss are heading toward the stationary object.

When the near miss is caused by a moving object (e.g., an animal or an erratic driver), the near miss system 130 may identify potential future positions of the moving object. When the moving object is another vehicle the near miss system 130 may identify whether the other vehicle is traveling in the same or a different direction than the vehicle detecting the near miss and determine where to broadcast the warning message accordingly.

The server 125 may monitor the locations of multiple mobile devices as reported by the mobile devices. The server 125 may identify one or more mobile devices that are near the vehicle 124 and may be at risk of an accident. The near miss may be caused by an obstacle on the roadway. If one vehicle nearly has a collision because of the obstacle, upstream drivers behind the vehicle may also be at risk. Example obstacles may include an animal, a blown tire, a broken down car, or an accident. The server 125 may broadcast the warning message to a plurality of mobile devices that are in a trajectory or routed towards the previously identified near miss location.

The warning message may be communicated to other vehicles in a peer to peer system. That is the mobile device 122 may be in direct communication with other mobile devices using radio or wireless communication may include the family of protocols known as WiFi or IEEE 802.11, the family of protocols known as Bluetooth, or the family of protocols knows as near field communication (NFC). The mobile device 122 may send the warning message to all of the other mobile devices in the range of the wireless communication. The warning message may be relevant only to nearby vehicles. The wireless communication may be able to travel 100 meters, 500 meters, or another distance.

In one alternative, the peer to peer system may use cellular technologies (analog advanced mobile phone system (AMPS), the global system for mobile communication (GSM), third generation partnership project (3GPP), code division multiple access (CDMA), personal handy-phone system (PHS), and 4G or long term evolution (LTE) standards), or another protocol.

Figure 4:
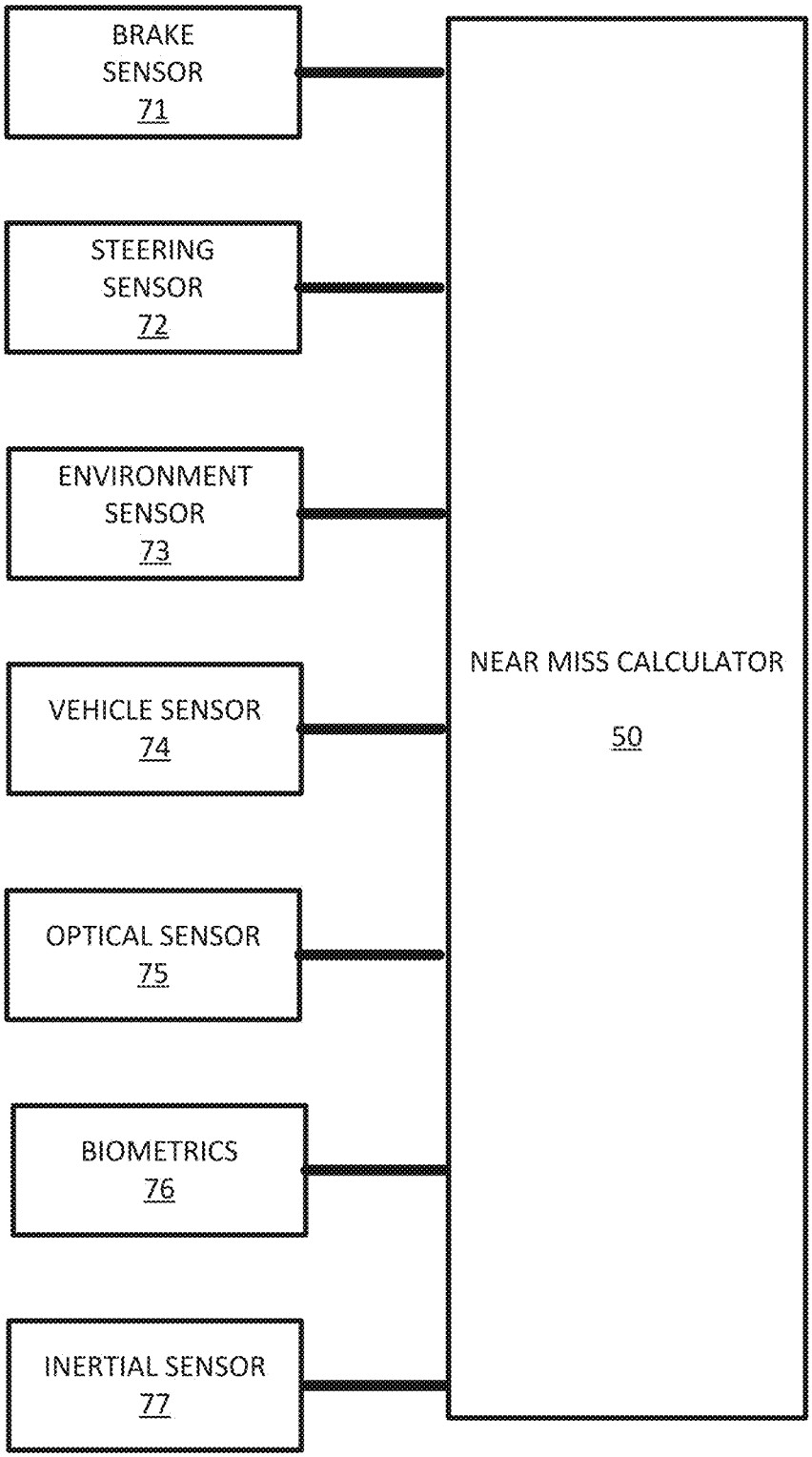
FIG. 4 illustrates example sensor arrays.

FIG. 4 illustrates example sensor arrays. A near miss calculator 50 may receive data from any combination of a brake sensor 71, a steering sensor 72, an environment sensor 73, a vehicle sensor 74, an optical sensor 75, a biometric sensor 76, and an inertial sensor 77. The near miss calculator 50 may also receive the location data described above. Additional, different, or fewer sensors may be used. The near miss calculator 50 may be implemented by the mobile device 122 or the server 125 individually or in combination.

The brake sensor 71 may be a brake pedal sensor that detects displacement of the brake pedal of the vehicle. The brake sensor 71 may detect the actuation of the brake pads near the wheel of the vehicle. The brake sensor 71 may be a circuit that detects operation of the brakes through an anti-lock brake system.

The steering sensor 72 may be a steering wheel sensor that detects movement of the steering wheel of the vehicle. The steering sensor 73 may detect the angle of the steering wheel. The steering sensor 72 may detect the angle of the front wheel of the vehicle.

The environment sensor 73 may detect the environment of the vehicle. The environment sensor 73 may include a weather sensor such as a thermometer, barometer, or a rain sensor. The rain sensor may detect the movement of windshield wipers. Data from a combination of the rain sensor and the thermometer may determine if conditions suggest icy roads. The environment sensor 73 may detect wind.

The vehicle sensor 74 may detect an operation of the vehicle. The vehicle sensor 74 may include a throttle sensor that measures a position of a throttle of the engine or a position of an accelerator pedal, a speedometer sensor, or a tachometer sensor. The vehicle sensor 74 may detect a malfunction of the vehicle. For example, the vehicle sensor 74 may be a tire pressure sensor.

The optical sensor 75 may include a camera, a LiDAR device, a proximity sensor, or another sensor configured to detect distances to nearby objects or when a nearby object exists. The optical sensor 75 may send a signal that reflects off another object and is detected by the optical sensor 75.

The biometric sensor 76 may detect human characteristics of the driver that may be indicative or a near miss. For example, the biometric sensor 76 may be a grip sensor that detects when the driver tightens the grip on the steering wheel, which may indicate an accident nearly occurred. The biometric sensor 76 may detect the user's heart rate or breathing rate. Increased heart rates or breathing rates may indicate that a near miss has occurred.

The biometric sensor 76 may detect the reaction of the user after the near miss occurs. For example, the biometric sensor 76 may be a microphone that records the sounds associated with the vehicle. The microphone may records tire squeals, horn honks, or passenger screams. The microphone may record an audible response from the driver. The audible response may state that the near miss occurred. The mobile device 122 may prompt the user (e.g., were you nearly in an accident) and receive a response through the microphone. The mobile device 122 may audibly or visually prompt the user (e.g., we detected you were X feet from an accident) and ask for a confirmation that this occurred. The warning message may be sent to other vehicles based on an affirmative confirmation that the near miss occurred.

The inertial sensor 77 may include an inertial measurement unit (IMU) including one or more of an accelerometer, a gyroscope, and a magnetic sensor. The inertial sensor 77 may generate data indicative of the acceleration, deceleration, rotational acceleration, and rotation deceleration experienced by the vehicle. These quantities may be analyzed (e.g., calculation of the derivative) to identify a change in acceleration or deceleration, which may be referred to as a jerk factor. The jerk factor measures how hard the force on the passengers was during the near miss.

The near miss calculator 50 may identify a near miss based on any one of the sensors. For example, the near miss calculator 50 may compare the sensor data to a threshold indicative of a near miss. The threshold may be a swerve threshold that is compared to sensor data from the steering sensor 72. For example, when the steering wheel is turned more than a predetermined angle, the near miss calculator 50 may identify that a near miss has likely occurred. In another example, when the steering wheel is turned more than a predetermined angle and, at the same time, the vehicle is moving more than a threshold speed, the near miss calculator 50 identifies that a near miss has likely occurred.

In another example, the threshold may be a braking threshold. When a predetermined amount of pressure is applied to the brake pedal or braking mechanism, the near miss calculator 50 identifies that a near miss has likely occurred. The braking threshold may be dependent on the functional classification of the road. For example, on a highway, hard braking may be a good indicator that a near miss has occurred. On surface streets, the correlation may be less reliable.

The near miss calculator 50 may calculate a score based on multiple sensors. The score may have any combination of a brake component from the brake sensor 71, a steering component from the steering sensor 72, an environment component from the environment sensor 73, an engine component from the engine sensor 74, a proximity component from the optical sensor 75, a biometric component from the biometric sensor 76, and an inertial component from the inertial sensor 77. The score may be calculated as a sum or average of any combination of these components. The score may be compared to a threshold to determine whether a near miss occurred.

The degree of the near miss may be determined based on the score. Different score ranges may be assigned to different degrees. A first range of scores corresponds to a minor near miss, a second range of scores corresponds to average near misses, and a third range of scores corresponds to major near misses. The near miss system 130 may process the near miss according to the ranges. For example, the minor near misses may be logged for further research but no warnings generated. The average near misses may be communicated to the user of the vehicle and the major near misses may be communicated to other vehicles. In another example, the average near misses are communicated to other vehicles at a first distance range and the major near misses are communication to other vehicles at a second distance range. The second distance range may be greater than the first distance range at a preset ratio (e.g., 2).

The near miss calculator 50 may adjust the score based on the response of the driver to the near miss. The biometric sensor 76 or the position circuitry may detect the response of the driver to the near miss. In one example, when the driver continues to drive normally, the score is decreased. In another example, when the driver pull off the side of the road, the score is increased. Pulling off the road may indicate that the driver was shaken up, scared, or physiologically affected, which may be indicative that a near miss occurred.

Figure 5:
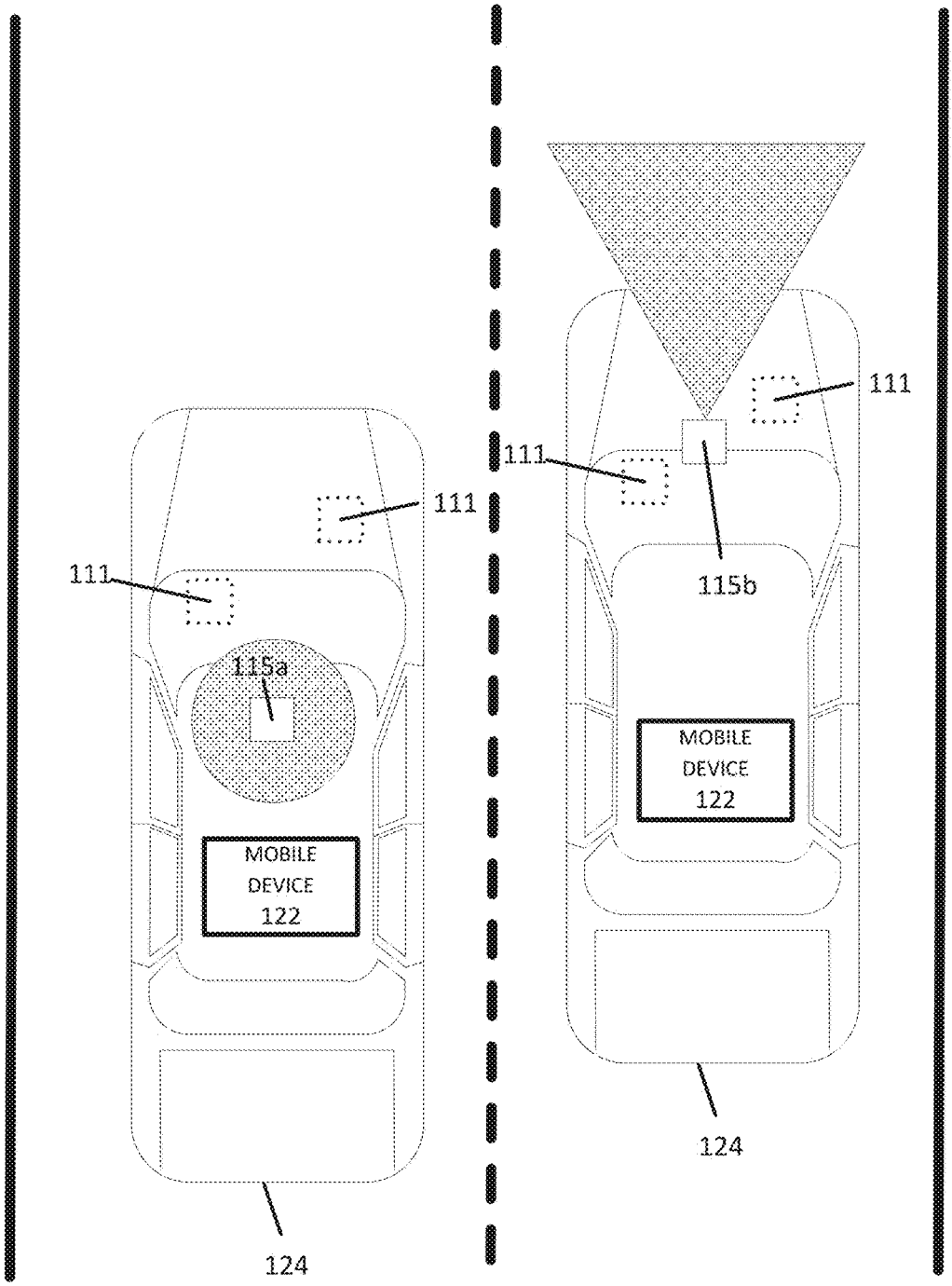
FIG. 5 illustrates automated driving systems and sensor arrays.

FIG. 5 illustrates placement of example sensor arrays 111 on vehicles 124 for determining near collisions. The vehicles 124 may be assisted driving vehicles. Assisted driving vehicles include autonomous vehicles, highly assisted driving (HAD), and advanced driving assistance systems (ADAS). Any of these assisted driving systems may be incorporated into mobile device 122. Alternatively, an assisted driving device may be included in the vehicle 124. The assisted driving device may include memory, a processor, and systems to communicate with the mobile device 122.

The term autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes. The autonomous vehicle may steer, brake, or accelerate the vehicle based on the warning message indicative of a near miss.

A highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode in which the human operator exercises a degree of control over the movement of the vehicle. The vehicles may also include a completely driverless mode. Other levels of automation are possible. The HAD vehicle may control the vehicle through steering or braking in response to the warning message indicative of a near miss occurring at the vehicle or at a nearby vehicle.

Similarly, ADAS vehicles include one or more partially automated systems in which the vehicle alerts the driver. The features are designed to avoid collisions automatically. Features may include adaptive cruise control, automate braking, or steering adjustments to keep the driver in the correct lane. ADAS vehicles may issue controls for these feature in response to the warning message indicative of a near miss occurring at the vehicle or at a nearby vehicle.

The vehicles 124 may be equipped with a mobile device 122 and a sensor array 111 including one or a combination of the sensors described with respect to FIG. 4. The sensors may include a camera. One example camera 115*a* is mounted on the top of the vehicle and has a 360 degree field of view, and another type of camera 115*b* is mounted on a front, rear, or side of the vehicle 124 and has a wide angle view less than a 360 field of view.

The mobile device 122 or server 125 may be configured to analyze the images or video collected by a camera. The images may be processed using computer vision to identify one or more nearby objects. Example image processing techniques include vector classification, edge detection, and feature extraction. In one example, the camera captures images of the road surface in front of the vehicle, and the mobile device 122 or the server 125 may determine when any foreign object is present on the road surface.

The mobile device 122 may be a personal device such as a mobile phone equipped with position circuitry (e.g., global positioning system (GPS)) and an inertial measurement unit (IMU). The mobile device 122 may be a specialized device (e.g., not a mobile phone) mounted or otherwise associated with the vehicle 124 and similarly equipped with position circuitry and an IMU. Additional, different, or fewer components may be included.

The automated driving systems may analyze the near miss to determine how where a collision avoidance system is working. For example, after a collision avoidance feature is activated to cause the vehicle to break, change steering direction, or another function, the near miss system 130 may determine whether a near miss occurred or a score of the near miss. Thus, the near miss system 130 may determine how close the vehicle came to the obstacle after the collision avoidance feature was activated. The near miss system 130 may determine whether an accident occurred anyway. The near miss system 130 may determine when the collision avoidance feature should be activated early or with lower near miss scores.

Figure 6:
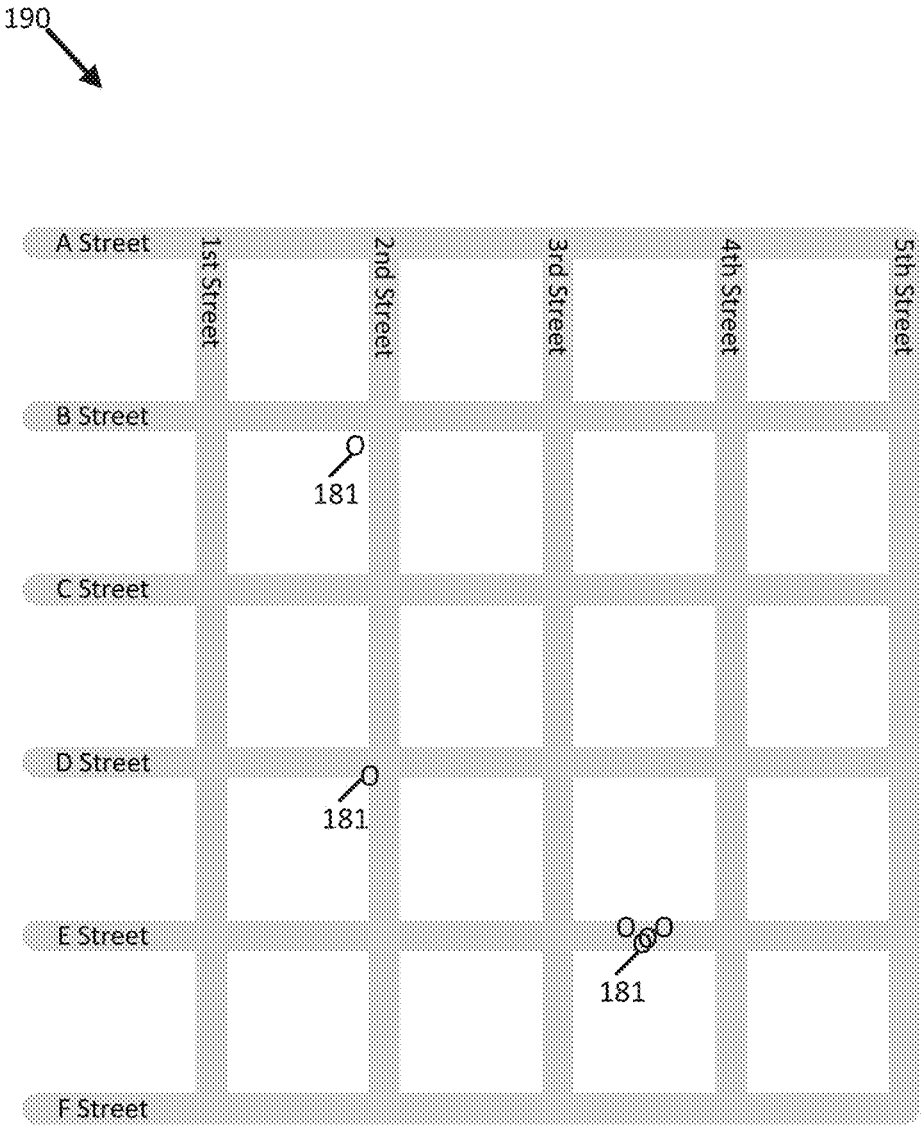
FIG. 6 illustrates an example map of near miss locations.

FIG. 6 include a map 190 having near miss locations 181. When the near miss is detected, the server 125 may store the location of the near miss in the database 123. When near misses cluster at a particular area, the server 125 may identify that this location should be reported to all mobile devices 122 that are routed past or approach the location. The cluster may be identified when a predetermined number of near misses have been reported within a predetermined geographic area. For example, the server 125 may identify the near miss location when three or more near misses are reported within a geographic region (e.g., 10 meters) of each other. The geographic region for the cluster may be defined according to the speeds of the vehicles (e.g., higher speeds relate to larger geographic regions) or based on the functional classification of the road segment (e.g., larger roads relate to larger geographic regions).

In one example, the cluster of the near miss locations may be analyzed to identify a traffic event (e.g., traffic congestion). For example, when traffic is backed up along a road, vehicles may repeatedly brake heavily upon approaching the traffic events at a high speeds. The server 125 may identify the traffic event from the cluster of near misses and report the traffic event on a map or report the traffic event to users that have requested routes that pass the traffic event. The server 125 may adjust a route in response to the traffic event.

Figure 7:
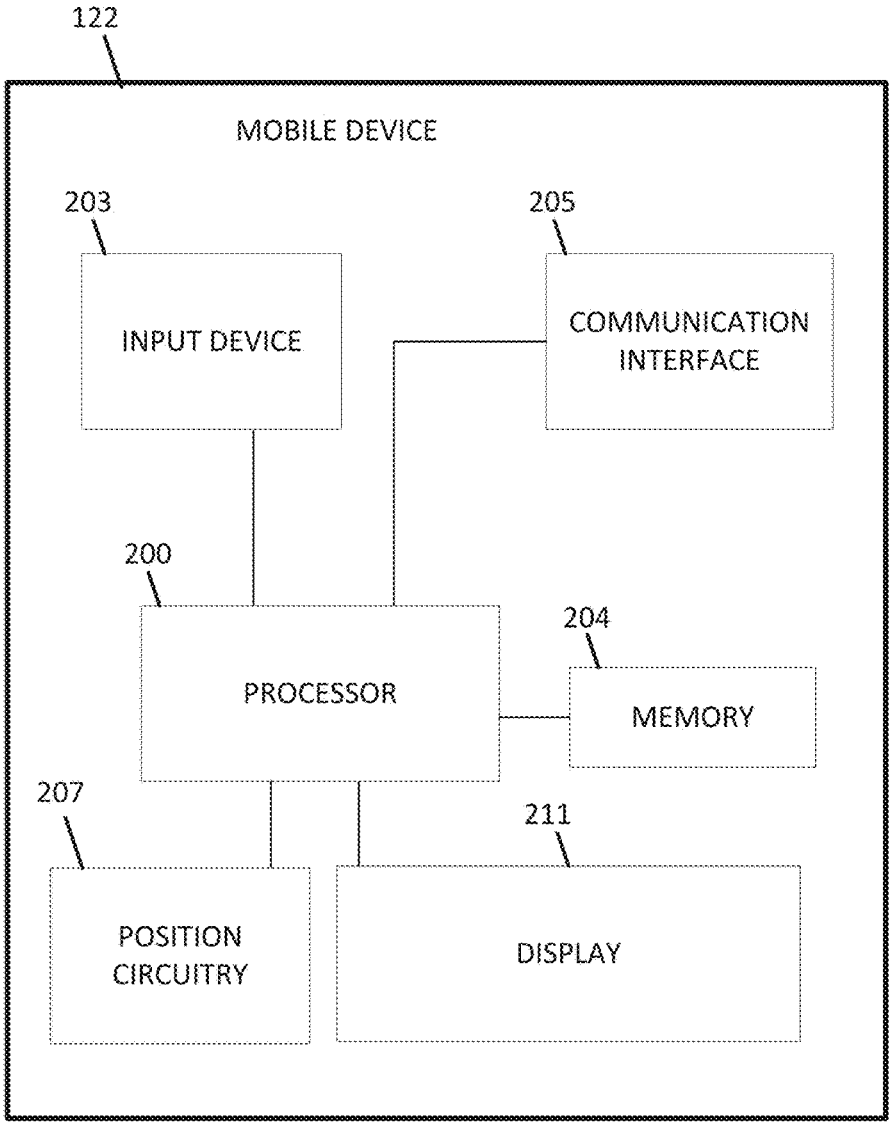
FIG. 7 illustrates an example mobile device for the system of FIG. 1.
Figure 8:
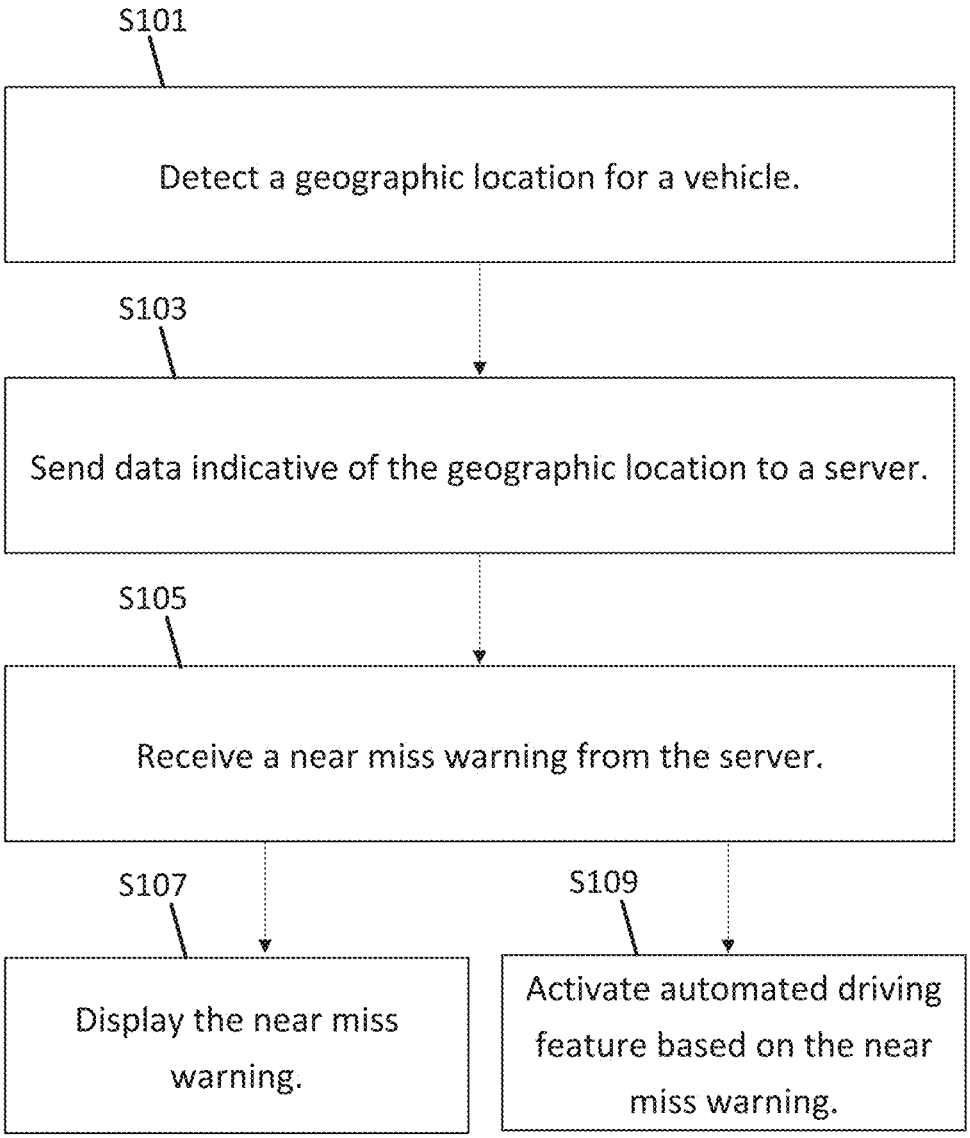
FIG. 8 illustrates an example flowchart for communicating near miss warnings.

FIG. 7 illustrates an exemplary mobile device 122 of the system of FIG. 1. The mobile device 122 includes a processor 200, a memory 204, an input device 203, a communication interface 205, position circuitry 207, and a display 211. Additional, different, or fewer components are possible for the mobile device/personal computer 122. FIG. 8 illustrates an example flowchart for identifying near miss situations or other risky maneuvers. The acts of FIG. 8 may be performed by the mobile device 122, an advanced driving assistance system (ADAS), a HAD device or an autonomous vehicle, any of which may be referred to as a computing device. The acts may be applied in a different order. Acts may be omitted or repeated. Additional acts may be added.

At act S101, the position circuitry 207 detects a geographic position of the vehicle. At act S103, the processor 200 or the communication interface 205 sends data indicative of the geographic position to the server 125. The server 125 may access geographic database 123 to determine whether the geographic location is within a predetermined distance to a near miss that has occurred in a recent time period. The recent time period may be 10 seconds, 1 minute, or another value. The length of the recent time period may be proportional to the score of the near miss. That is, near misses with higher scores stay in effect for a longer time period than the near misses with lower scores.

At act S105, the processor 200 or the communication interface 205 receives a near miss warning from the server 125 or wirelessly from another mobile device 122. At act S107, in response to the near miss warning, the processor 200 causes the display 211 to graphically or textually present the near miss warning. The display 211 may warn the driver that an incident occurred ahead. The display 211 may present a map with a graphical indicator for the location of the near miss.

At act S109, in response to the near miss warning, the processor 200 may activate an automated driving feature. The automated driving feature may cause the vehicle to slow down, change steering direction, sound a horn, or another function. Acts S107 and S109 may be alternatives or both performed in response to the near miss warning.

Act S101 is optional. In one embodiment, no geographic position is used. A vehicle may experience a near miss, and in response, the processor 200 identifies that sensor data is indicative of a near miss and generates a warning message. The warning message is transmitted wirelessly by the communication interface 205. No specific recipients may be known for the warning message or specified by the warning message. The warning message may be automatically broadcast using radio communication (e.g., citizen band radio, handheld transceiver, Bluetooth communication, or another type of short range or ad-hoc signal). Examples ranges for this type of radio communication may be 10-1000 meters. Any nearby car may receive the warning message, and a corresponding mobile device of the receiving car may perform acts S105, S107, and/or S109 to process the warning message.

Figure 9:
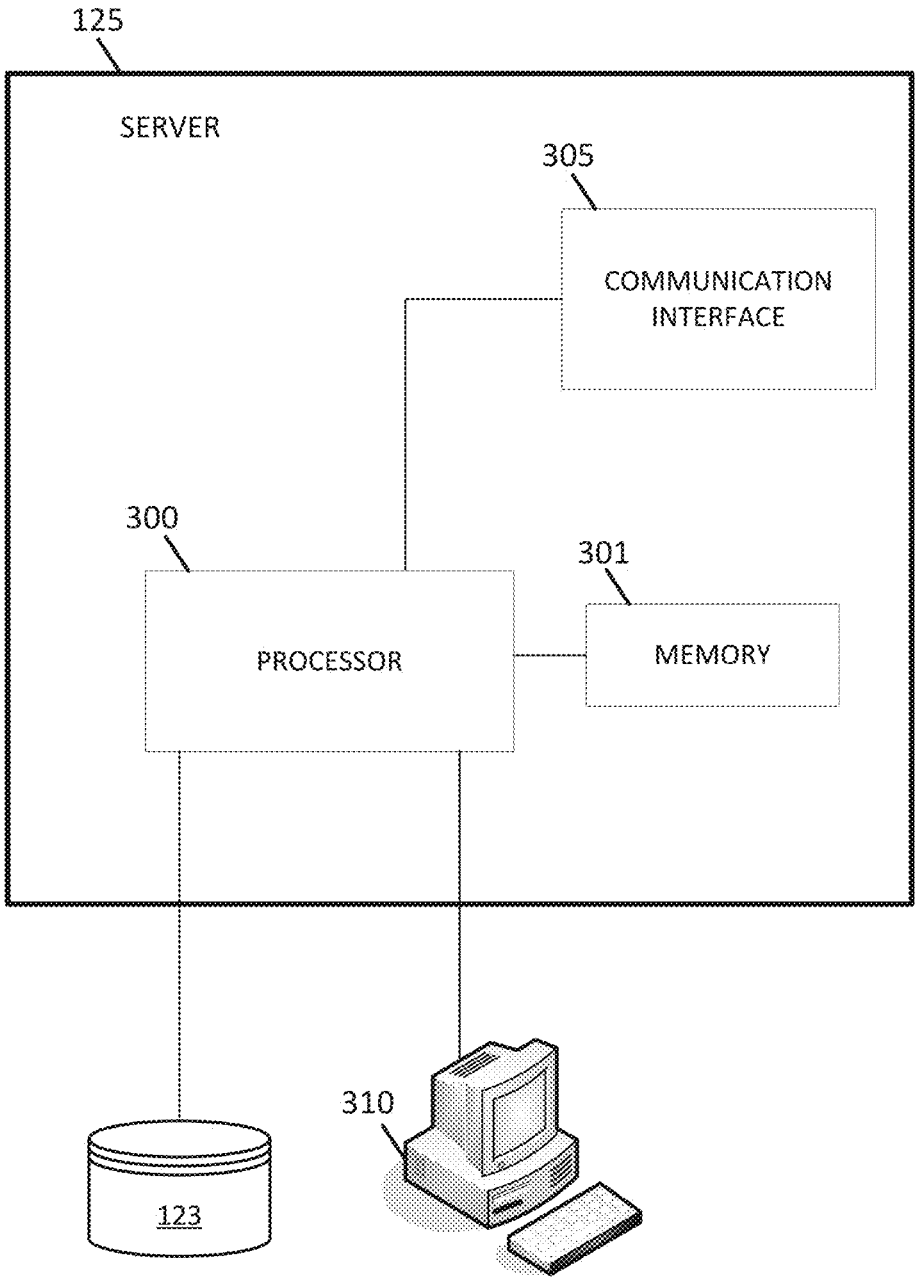
FIG. 9 illustrates an example network device of the system of FIG. 1.
Figure 10:
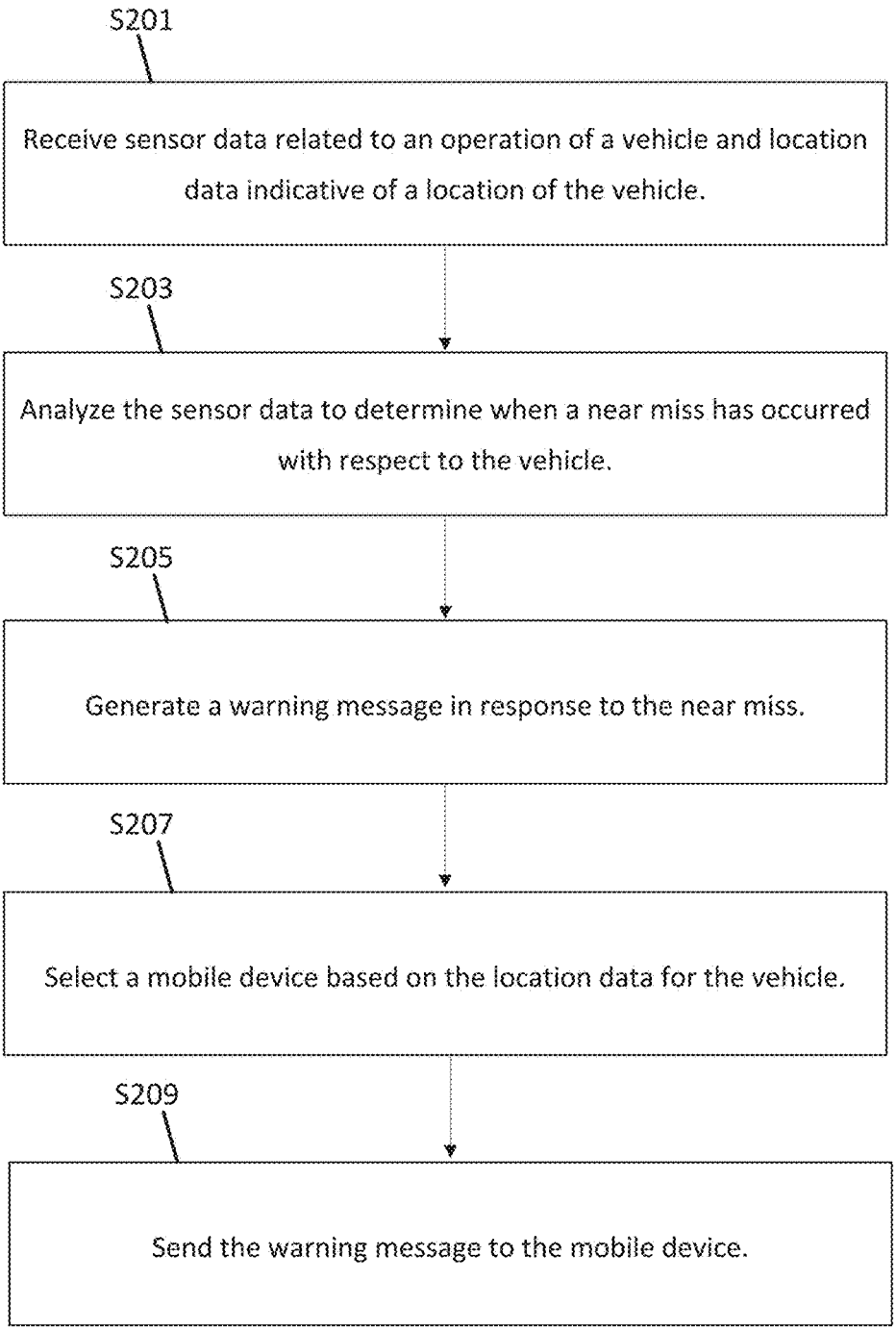
FIG. 10 illustrates an example flowchart for communicating near miss warnings.

FIG. 9 illustrates an example network device (e.g., server 125) of the system of FIG. 1. The server 125 includes a processor 300, a communication interface 305, and a memory 301. The server 125 may be coupled to a database 123 and a workstation 128. The workstation 128 may be used as an input device for the server 125 for entering values for the distance thresholds, geographic regions, or other values. In addition, the communication interface 305 is an input device for the server 125. In certain embodiments, the communication interface 305 may receive data indicative of user inputs made via the workstation 128 or the mobile device 122. FIG. 10 illustrates an example flowchart for identifying false positives in image data. The acts of the flowchart of FIG. 12 may alternatively be performed by the server 125 or another computing device. Different, fewer, or additional acts may be included.

At act S201, the processor 300 or communication interface 305 receives sensor data related to an operation of a vehicle and/or location data indicative of a location of the vehicle. The sensor data related to the operation of the vehicle may be location data or video. The sensor data related to the operation of the vehicle may be any of the sensor data described above.

At act S203, the processor 300 analyzes the sensor data to determine when a risky maneuver or a near miss has occurred with respect to the vehicle. The processor 300 may determine when the vehicle has traveled dangerously close to a vehicle or another type of obstacle.

The processor 300 may determine different types of near misses. In one example, the processor 300 distinguishes between confirmed near misses and likely near misses. A confirmed near miss may be detected by a video or other proximity sensor. A predicted near miss may an estimation based on steering sensor data. Confirmed near misses may be immediately communicated to other vehicles, and predicted near misses may be communicated with they exceed a threshold near miss score. In another example, when a predetermined number (e.g., 2) predicted near misses occur, the occurrence is communication to other vehicles.

At act S205, the processor 300 generates a warning message in response to the risky maneuver or the near miss. At act S207, the processor selects a mobile device based on the location data for the vehicle or for the risky maneuver or near miss. The warning message may be sent to other vehicles in the area of the risky maneuver or near miss. The warning message may be broadcast using a traffic system such as traffic message channel (TMC). In one example, vehicles traveling in the same road segment as the near miss are sent the warning message. At act S209, the communication interface 305 sends the warning message to one or more mobile devices or vehicles. The sequence of identifying recipients for the warning message and sending the warning message may occur automatically (e.g., without user approval or intervention).

The road link data records may be associated with attributes of or about the roads such as, for example, geographic coordinates, street names, address ranges, speed limits, turn restrictions at intersections, and/or other navigation related attributes (e.g., one or more of the road segments is part of a highway or tollway, the location of stop signs and/or stoplights along the road segments), as well as points of interest (POIs), such as gasoline stations, hotels, restaurants, museums, stadiums, offices, automobile dealerships, auto repair shops, buildings, stores, parks, etc. The node data records may be associated with attributes (e.g., about the intersections) such as, for example, geographic coordinates, street names, address ranges, speed limits, turn restrictions at intersections, and other navigation related attributes, as well as POIs such as, for example, gasoline stations, hotels, restaurants, museums, stadiums, offices, automobile dealerships, auto repair shops, buildings, stores, parks, etc. The geographic data may additionally or alternatively include other data records such as, for example, POI data records, topographical data records, cartographic data records, routing data, and maneuver data.

The databases 123 may be maintained by one or more map developers (e.g., the first company and/or the second company). A map developer collects geographic data to generate and enhance the database. There are different ways used by the map developer to collect data. These ways include obtaining data from other sources such as municipalities or respective geographic authorities. In addition, the map developer may employ field personnel (e.g., the employees at the first company and/or the second company) to travel by vehicle along roads throughout the geographic region to observe features and/or record information about the features. Also, remote sensing such as, for example, aerial or satellite photography may be used.

The database 123 may be master geographic databases stored in a format that facilitates updating, maintenance, and development. For example, a master geographic database or data in the master geographic database is in an Oracle spatial format or other spatial format, such as for development or production purposes. The Oracle spatial format or development/production database may be compiled into a delivery format such as a geographic data file (GDF) format. The data in the production and/or delivery formats may be compiled or further compiled to form geographic database products or databases that may be used in end user navigation devices or systems.

For example, geographic data is compiled (such as into a physical storage format (PSF) format) to organize and/or configure the data for performing navigation-related functions and/or services, such as route calculation, route guidance, map display, speed calculation, distance and travel time functions, and other functions, by a navigation device. The navigation-related functions may correspond to vehicle navigation, pedestrian navigation, or other types of navigation. The compilation to produce the end user databases may be performed by a party or entity separate from the map developer. For example, a customer of the map developer, such as a navigation device developer or other end user device developer, may perform compilation on a received geographic database in a delivery format to produce one or more compiled navigation databases.

The workstation 128 may be a general purpose computer including programming specialized for providing input to the server 125. For example, the workstation 128 may provide settings for the server 125. The settings may include distance thresholds or score thresholds for determining when a near miss has occurred based on the sensor data. The settings may occur a size of the broadcast region to broadcast near miss warnings. The settings may assign driver assistance features to various near miss scores or types of near misses. The workstation 128 may include at least a memory, a processor, and a communication interface.

The thresholds for defining a near miss and the sizes geographic regions for broadcasting a near miss may depend on the functional class of the associated road segment where the near miss may have occurred. Table 1 lists example classification systems that may be assigned numeric values for functional class. The functional class of the road segment may be described as a numerical value (e.g., 1, 2, 3, 4, and 5) represented in the feature vector. Functional class 1 may be highways while functional class 5 may be small streets. Table 1 further illustrates schemes having three to six functional classes.

TABLE 1

| Simple System | Complex System | U.S. Long Distance Roads | Highway Tags |
|---|---|---|---|
| Arterial Road | Interstates | Interstate Expressway | Motorway |
| Collector Road | Principal Arteries | Federal Highway | Trunk |
| Local Road | Minor Arteries | State Highway | Primary |
| | Major Collector | County Highway | Secondary |
| | Minor Collector | Local Road | Tertiary |
| | Local Road | | Residential |

One example of a simple system includes the functional classification maintained by the United States Federal Highway administration. The simple system includes arterial roads, collector roads, and local roads. The functional classifications of roads balance between accessibility and speed. An arterial road has low accessibility but is the fastest mode of travel between two points. Arterial roads are typically used for long distance travel. Collector roads connect arterial roads to local roads. Collector roads are more accessible and slower than arterial roads. Local roads are accessible to individual homes and business. Local roads are the most accessible and slowest type of road.

An example of a complex functional classification system is the urban classification system. Interstates include high speed and controlled access roads that span long distances. The arterial roads are divided into principle arteries and minor arteries according to size. The collector roads are divided into major collectors and minor collectors according to size. Another example functional classification system divides long distance roads by type of road or the entity in control of the highway. The functional classification system includes interstate expressways, federal highways, state highways, local highways, and local access roads. Another functional classification system uses the highway tag system in the Open Street Map (OSM) system. The functional classification includes motorways, trunk roads, primary roads, secondary roads, tertiary roads, and residential roads.

The computing device processor 200 and/or the server processor 300 may include a general processor, digital signal processor, an application specific integrated circuit (ASIC), field programmable gate array (FPGA), analog circuit, digital circuit, combinations thereof, or other now known or later developed processor. The mobile device processor 200 and/or the server processor 300 may be a single device or combinations of devices, such as associated with a network, distributed processing, or cloud computing. The computing device processor 200 and/or the server processor 300 may also be configured to cause an apparatus to at least perform at least one of methods described above.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 301 may be removable from the mobile device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

In the above described embodiments, the network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium is described to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term "circuitry" or "circuit" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., E PROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A method comprising:

receiving sensor data related to an operation of a first vehicle;

receiving location data indicative of a location of the first vehicle;

identifying a variable distance threshold based on the operation of the first vehicle or the location of the first vehicle;

analyzing the sensor data to determine whether a near collision has occurred based on the variable distance threshold;

generating a warning message in response to the determination of the near collision after the near collision has occurred;

selecting a second vehicle, that is in proximity to the first vehicle at a time of the near collision, based on the location data for the first vehicle; and sending the warning message to the second vehicle.

2. The method of claim 1, wherein the sensor data includes data from a brake sensor, a steering sensor, a proximity sensor, or an accelerometer.

3. The method of claim 1, wherein sending the warning message to the mobile device comprises:

broadcasting the warning message to a plurality of mobile devices.

4. The method of claim 3, further comprising:

identifying a geographic region based on the location data; and selecting the plurality of mobile devices within the geographic region.

5. The method of claim 1, wherein the mobile device displays a warning to a user.

6. The method of claim 1, wherein the mobile device provides automated driving assistance in response to the warning message.

7. The method of claim 1, wherein the sensor data is generated by a camera or a ranging device.

8. The method of claim 1, wherein sending the warning message to the mobile device comprises wireless communication between vehicles.

9. The method of claim 1, wherein the vehicle is a first vehicle, and the mobile device is an autonomous driving system of a second vehicle.

10. An apparatus comprising:

at least one processor; and at least one memory including computer program code for one or more programs; the at least one memory and the computer program code configured to, with the at least one processor, cause the apparatus to at least:

receive sensor data describing a maneuver of a vehicle;

receive location data indicative of a geographic location of the vehicle;

identify a variable distance threshold based on the operation of the vehicle or the location of the vehicle;

analyze the sensor data, using the variable distance threshold, to determine whether a near miss has occurred with respect to the vehicle and an obstacle;

generate a warning message in response to the near miss;

select a mobile device that is in proximity to the vehicle at a time of the near miss based on the location data for the vehicle; and send the warning message to the mobile device.

11. The apparatus of claim 10, wherein the vehicle is a first vehicle, and the mobile device is associated with a second vehicle.

12. The apparatus of claim 10, wherein the near miss is an unplanned event that had potential to cause damage to the vehicle but damage was avoided.

13. The apparatus of claim 10, wherein the sensor data includes data from a brake sensor, a steering sensor, a proximity sensor, or an accelerometer.

14. The apparatus of claim 10, wherein the warning message is broadcasted to a plurality of mobile devices.

15. The apparatus of claim 14, wherein the warning message is broadcasted according to a range of wireless communication.

16. The apparatus of claim 14, wherein the warning message is broadcasted according to a geographic region based on the location data.

17. The apparatus of claim 14, wherein the mobile device provides automated driving assistance in response to the warning message.

18. A non-transitory computer readable medium including instructions that when executed are operable to:

receive sensor data related to an operation of a vehicle;

identify a variable distance threshold based on the operation of the vehicle or a location of the vehicle;

analyze the sensor data, using the variable distance threshold, to determine whether a near miss has occurred with respect to the vehicle;

generate a warning message in response to the determination that a near miss has occurred; and transmit the warning message to the at least one nearby vehicle or device therein within a predetermined distance of the near miss.

19. The non-transitory computer readable medium of claim 18, wherein the warning message is automatically generated and transmitted in response to the determination that a near miss has occurred.

* * * * *